US010844585B2

(12) United States Patent
Feldman et al.

(10) Patent No.: US 10,844,585 B2
(45) Date of Patent: Nov. 24, 2020

(54) SANITARY-WARE FLUSHING SYSTEM

(71) Applicants: Yoseph Feldman, Tel Aviv (IL); Emanuel Mendes, Petach Tikva (IL)

(72) Inventors: Yoseph Feldman, Tel Aviv (IL); Emanuel Mendes, Petach Tikva (IL)

( * ) Notice: Subject to any disclaimer, the term of this patent is extended or adjusted under 35 U.S.C. 154(b) by 0 days.

(21) Appl. No.: 15/504,023

(22) PCT Filed: Jul. 20, 2016

(86) PCT No.: PCT/IL2016/050790
§ 371 (c)(1),
(2) Date: Feb. 15, 2017

(87) PCT Pub. No.: WO2017/013652
PCT Pub. Date: Jan. 26, 2017

(65) Prior Publication Data

US 2018/0119402 A1 May 3, 2018

Related U.S. Application Data

(60) Provisional application No. 62/194,304, filed on Jul. 20, 2015.

(51) Int. Cl.
*E03D 3/00* (2006.01)
*E03D 3/04* (2006.01)
*E03D 5/01* (2006.01)

(52) U.S. Cl.
CPC ..... *E03D 3/04* (2013.01); *E03D 3/00* (2013.01); *E03D 5/01* (2013.01)

(58) Field of Classification Search
CPC .... E03D 3/00; E03D 3/04; E03D 3/10; E03D 3/12; F15B 2201/31
(Continued)

(56) References Cited

U.S. PATENT DOCUMENTS 3,029,443 A * 4/1962 Naccarato ..... E03D 3/10 4/362
4,183,108 A 1/1980 Hamilton
(Continued)

FOREIGN PATENT DOCUMENTS

DE 3536967 A1 4/1987
EP 1293613 A1 3/2003
(Continued)

OTHER PUBLICATIONS

Machine Translation for JP H08277565. Retrieved from Espacenet. (Year: 2019).*
(Continued)

*Primary Examiner* — Erin Deery

(57) ABSTRACT

Sanitary-ware coupled to a mains water supply, the sanitary-ware including a flushing assembly including a tank having a first chamber having a first volume and an inlet, and a second chamber having an outlet and a second volume, larger than the volume of the first chamber; the inlet coupled to a source of water at high pressure receiving a first quantity of water at an inlet pressure from the source; and a pressure exchange mechanism disposed between the first chamber and the second chamber, wherein a first quantity of water in the first chamber causes a second quantity of water in the second chamber, larger than the first quantity, to be pushed out of the second chamber through the outlet at a pressure lower than the inlet pressure by the pressure exchange mechanism. Preferably, the source of water at high pressure is a mains water supply.

18 Claims, 15 Drawing Sheets

(58) Field of Classification Search
USPC ..... 4/362, 354, 359, 380, 361; 91/433, 443
See application file for complete search history.

(56) References Cited

U.S. PATENT DOCUMENTS 4,232,409 A 11/1980 Van Pham
4,955,921 A * 9/1990 Basile ..... E03D 3/10 4/354
4,984,311 A * 1/1991 Basile ..... E03D 3/10 4/354
5,046,201 A * 9/1991 Steinhardt ..... E03D 3/10 4/354
5,553,333 A * 9/1996 Andersson ..... E03D 3/10 4/354
5,596,772 A 1/1997 Schoen
8,205,279 B2 * 6/2012 Devinat ..... A61H 35/02 4/620

FOREIGN PATENT DOCUMENTS

JP 9-5-2019-00339683 A 5/1994
JP 08277565 A * 10/1996

OTHER PUBLICATIONS

Machine Translation for DE 535967. Retrieved from Espacenet. (Year: 2019).*

* cited by examiner

SANITARY-WARE FLUSHING SYSTEM

RELATED APPLICATIONS

This application is a 35 USC § 371 National Stage application of international Application number PCT/IL2016/050790, having an international filing date of Jul. 20,2016 (now pending), which claims the benefit of US Provisional Patent Application No. 62/194,304 filed on Jul. 20, 2015. The disclosure of each of the prior applications is considered part of and is incorporated by reference in the disclosure of this application.

FIELD OF THE INVENTION

The present invention relates generally to the field of sanitary-ware and more specifically to the streamlining of the structure and installation of toilets having a flush mechanism.

BACKGROUND OF THE INVENTION

A toilet is a sanitation fixture used for the storing or disposal of human urine and feces. In developed countries, different forms of porcelain flush toilets are common: seats are usually used in the West while squat toilets are common in East Asia. These are connected to a sewer system in most urban areas and to septic tanks in less built-up areas.

A typical flush toilet is a vitreous, ceramic bowl containing water connected to a cistern for providing flushing water. The water in the toilet bowl is connected to a hollow drain pipe shaped like an upside-down U connecting the drain. One side of the U channel is arranged as a hollow siphon tube longer than the water in the bowl is high. The siphon tube connects to the drain. The bottom of the upside-down U-shaped drain pipe limits the height of the water in the bowl before it flows down the drain. The water in the bowl acts as a barrier to sewer gas entering and as a receptacle for waste. Sewer gas is vented through a vent pipe attached to the sewer line.

Historically the first flushing sanitary-ware toilet was suggested, ahead of his time, by Sir John Harrington in 1596, however, the lack of indoor plumbing in most residences barred its wide-scale adoption. It resurfaced two hundred years later when Alexander Cummings added the S-trap to it, a sliding valve between the bowl and the trap. The design and construction materials of the toilet have since evolved, however, traditionally the cistern and toilet bowl have been enclosed in distinctive housings. Furthermore they have either been physically distanced from each other, to take advantage of gravity for a cascade flush effect, placed for aesthetic considerations in visible proximity to one another in a monoblock style, or, alternatively, the cistern has been concealed within a wall in order to achieve a sleek look.

More recently, in the IN-TANK™ water closet manufactured by the company ROCA, the cistern has been integrated into the toilet bowl housing, thereby offering the sleekness of a concealed cistern, without the installation and maintenance implications of a hollow space in the wall. In order to achieve the integration of the cistern into the toilet bowl housing, the IN-TANK™ requires an electrical connection in order to power the air-pressure based technology of U.S. Pat. No. 8,615,822 (Vargas-1): 'An air activated toilet flush system . . . wherein the system for supplying ambient air into the reservoir comprises an open air path therethrough permitting free passage of air between the reservoir and the ambient environment when the system for supplying ambient air is turned off for forcing the water from the cistern into the bowl, and a water connection for filling the bowl.' Thus, while the commercially available IN-TANK™ avoids the installation complexity of a hollowed out wall space for fitting the cistern, it burdens the installation with an electrical connection, and moreover with one that is in proximity to a water supply. The power for the forcing the ambient air into the reservoir is aptly disclosed in Vargas-1: 'wherein the system for supplying ambient air to the reservoir is powered by electrical power.'

U.S. Pat. No. 8,701,220 (Vargas-2) discloses a toilet with a cistern integrated into the toilet bowl, comprising 'A jet powered toilet flushing system including: a toilet bowl; a reservoir; a fluid conduit between the reservoir and the toilet bowl; a jet inside the reservoir, the jet having a nozzle directed toward an entrance of the fluid conduit; a fill valve that supplies water to the jet; and a flow diverter in the reservoir, the flow diverter positioned to divert water flow: (a) from the jet nozzle into the entrance of the fluid conduit when the reservoir is full, or (b) from the jet nozzle away from the entrance of the fluid conduit and into the reservoir when the reservoir is empty.', wherein 'Prior to a flush (i.e.: when the reservoir is full), flow from the jet nozzle is sent directly into the fluid conduit. This causes the contents of the reservoir to be siphoned into the toilet bowl, flushing the toilet bowl.' While Vargas-2 forgoes the reliance of Vargas-1 on electrically powered air pressure, it resorts to a jet powered water system that may suffer from inappropriate water pressure in the infrastructure of the installation site, and is also prone to clogging due to water impurities.

Furthermore, water conservation is becoming more and more important. In response to the need for water conservation, dual flush toilets have been developed. In a dual flush toilet, there are two user-selectable flush quantities. A small flush is used to dispose of liquid waste, while a large flush, typically twice the quantity as a small flush, is used to dispose of solid waste. It will be appreciated that water conservation includes both changing flush quantities and prevention of leak failures.

It is therefore a long felt need to provide a device and method that streamlines the structure, installation and maintenance of sanitary ware integrating the cistern into the housing of the bowl, that does not require electrical power and does not require special adaptation to differing on site infrastructure and does not suffer from unreliability or the maintenance woes of a jet powered system. And it would be very desirable to have such a device that permits different flush quantities.

SUMMARY OF THE INVENTION

The present invention relates to a water toilet structure and installation including a cistern and a flushing water tank adapted to occupy to an optimal extent the cavity or space inherently existing between the bowl on the one hand and the housing on the other hand, wherein the liquid within the tank is flushed into the bowl by means of an appropriately shaped flushing assembly solely powered by the mains water supply pressure, acting as an hydraulic pump.

There is, thus, provided, according to embodiments of the present invention, a Sanitary-ware coupled to a mains water supply, the sanitary-ware including a flushing assembly including a tank having a first chamber having a first volume and an inlet, and a second chamber having an outlet and a second volume, larger than the volume of the first chamber; the inlet coupled to a source of water at high pressure receiving a first quantity of water at an inlet pressure from the source; and a pressure exchange mechanism disposed between the first chamber and the second chamber, wherein a first quantity of water in the first chamber causes a second quantity of water in the second chamber, larger than the first quantity, to be pushed out of the second chamber through the outlet at a pressure lower than the inlet pressure by the pressure exchange mechanism. Preferably, the source of water at high pressure is a mains water supply.

According to some embodiments of the invention, the pressure exchange mechanism is a piston. According to alternative embodiments, the pressure exchange mechanism includes first and second rotors coupled by an axle.

According to some embodiments of the invention, the flushing assembly includes at least one tank including: a first chamber having a first cross sectional area and a first volume coupled to a water supply and configured to receive water from the water supply; a second chamber holding flushing water and having a larger cross sectional area and larger volume than the first chamber; and a flushing outlet; a water cistern having a one-way valve disposed between the cistern and the second chamber for selective flow from the cistern to the second chamber, and a flushing mechanism powered by water pressure from the water supply including a piston mounted in the larger cross section chamber of the tank, acting as a barrier between the first chamber and the second chamber, causing water from the larger chamber of the tank to flow out of the flushing outlet.

According to preferred embodiments, the flushing assembly includes two tanks.

There is also provided, according to the invention, a method for flushing a sanitary-ware bowl associated with a flushing assembly, the method including introducing a first volume of water under pressure from a high pressure water supply to a first chamber of the flushing assembly; applying pressure to a volume of water, larger than the first volume, in a second chamber of the flushing assembly by the first volume of water in the first chamber by means of a pressure exchange mechanism; dispensing flushing water under lower pressure, by the pressure exchange mechanism, from the second chamber of the flushing assembly into the bowl to flush the bowl; and re-filling the second chamber of the flushing assembly with flushing water.

According to embodiments of the invention, the method includes introducing a first volume of water from a mains water supply to a first chamber of a tank, the first chamber having a first cross sectional area and a first volume, applying pressure, by the water in the first chamber, to a piston mounted in a second chamber of the tank, the second chamber holding flushing water and having a larger cross sectional area and larger volume than the first chamber, chamber dispensing flushing water under pressure from the second chamber of the tank through a flushing outlet into the bowl to flush the bowl; and re-filling the second chamber of the flushing assembly with flushing water.

BRIEF DESCRIPTION OF THE DRAWINGS

In order to better understand the invention and its implementation in practice, a plurality of embodiments will now be described, by way of non-limiting example only, with reference to the accompanying drawings, in which.

DETAILED DESCRIPTION OF THE INVENTION

Figure 1:
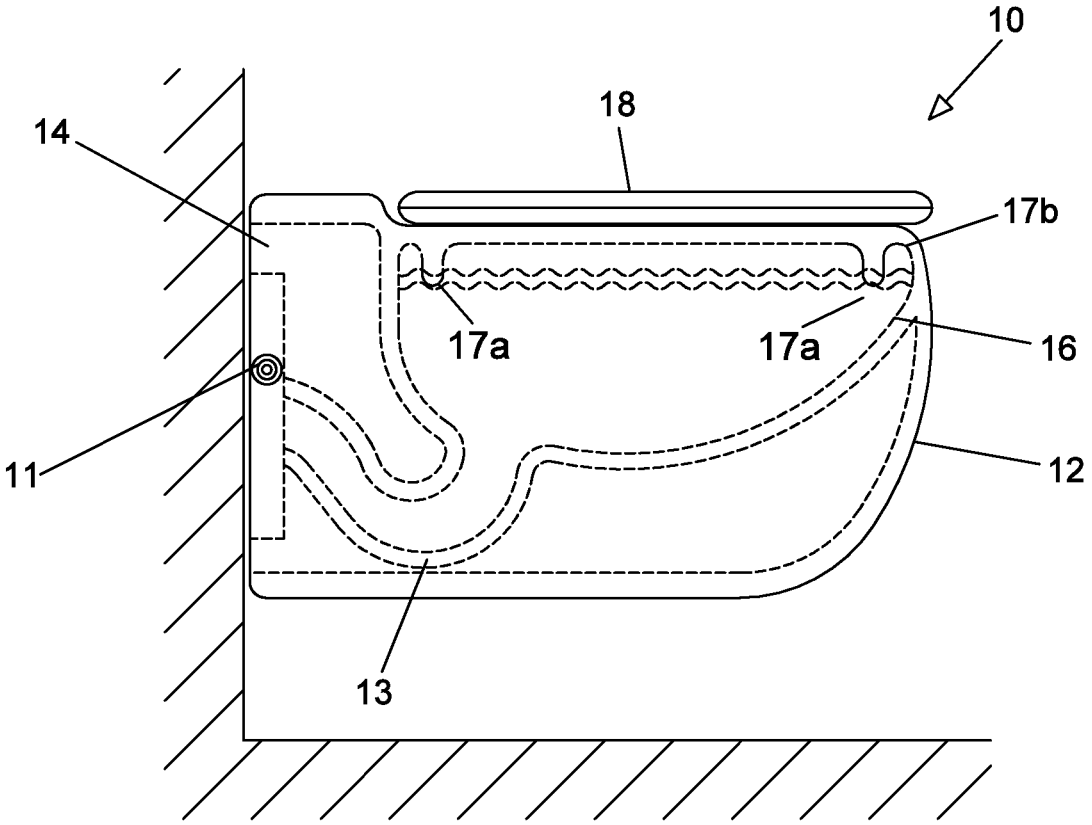
FIG. 1 is a side view of an embodiment of sanitary-ware constructed and operative in accordance with the present invention.

The following description is provided, alongside embodiments of the present invention, so as to enable any person skilled in the art to make use of said invention and sets forth the best modes contemplated by the inventor of carrying out this invention. Various modifications, however, will remain apparent to those skilled in the art, since the generic principles of the present invention have been defined specifically to provide a device and method for the streamlining of the structure and installation of sanitary-ware having a flush mechanism.

Additional features and advantages of the invention will become apparent from the following drawings and description.

The present invention relates to a sanitary-ware water toilet having a bowl inside a housing, including a cistern and a water tank with a flushing apparatus, adapted to occupy the majority of the space between the bowl and the housing, wherein the water from the tank is flushed into the bowl by means of a flushing assembly solely powered by a high pressure water supply, preferably the pressure of the mains water supply, utilizing a pressure exchange mechanism. In some embodiments of the invention, the flushing includes a tank having a first chamber that is of a first volume, a second chamber having a larger volume than the first chamber, and a pressure exchange mechanism disposed between the first chamber and the second chamber. Typically, the first and second chambers are coupled to one another, however it is not necessary that there be flow communication between them. Thus, alternatively, the first and second chambers can be physically separated with the pressure exchange mechanism between them. Preferably, a controller is provided to direct the flow through the flushing assembly. Thus, water from the high pressure water supply enters the controller, passes through a selector and a manifold (described in detail below), and the manifold directs the water flow in one of a plurality of pre-defined flow paths, such as to one tank, to both tanks or to a cistern.

According to some embodiments, the pressure exchange mechanism includes a piston disposed in the second chamber, between the first and second chambers. The relatively high pressure of the smaller volume of water in the first chamber, coming from the mains water supply, causes the piston to be pushed through the second chamber and, in turn, to push the larger quantity of water out of the larger chamber. In this way, the higher pressure of the water in the smaller chamber is spread over the larger surface area of the piston, which acts on the larger volume of water at lower pressure. In these embodiments, the larger chamber, which serves as a cylinder for the piston, as well as the piston, can have a cross-section of virtually any closed shape, not only round.

In other embodiments of the invention, the pressure exchange mechanism includes a tank having a first chamber that is of a first volume and a second chamber of larger volume than the first chamber. In these embodiments, the pressure exchange mechanism further includes a first rotor rotatingly disposed in the first chamber and a second rotor, of larger diameter, rotatingly disposed in the second chamber, where the first and second rotors are mounted on the same axle. Alternatively, any other mechanism can be utilized that permits a small quantity of water under relatively high pressure from the mains water supply to move a larger quantity of water under lower pressure.

Figure 2:
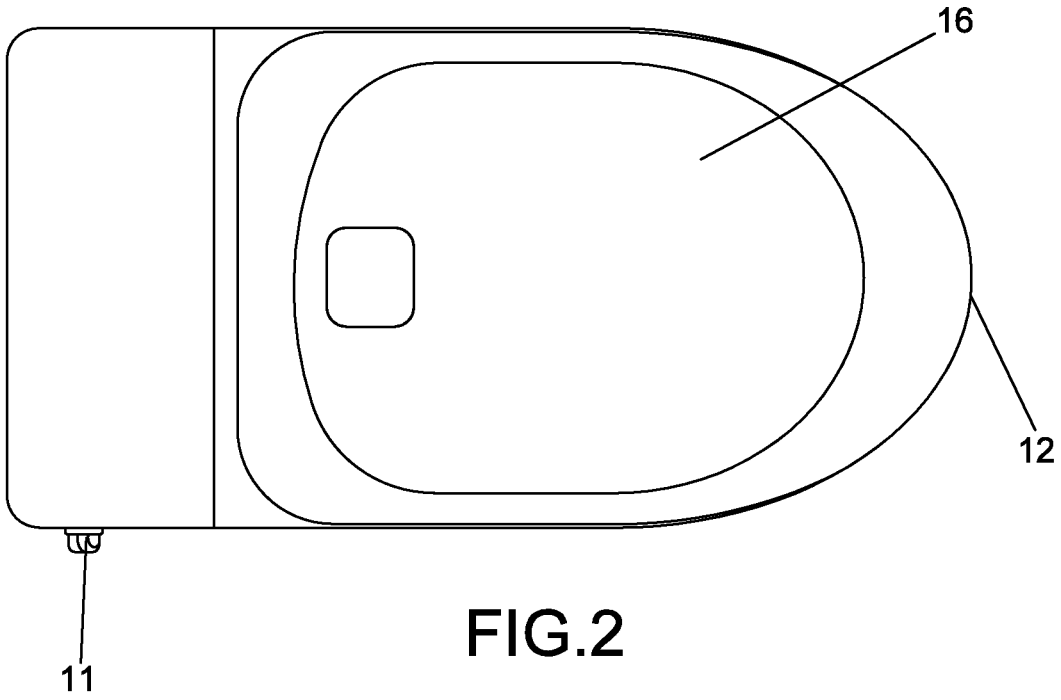
FIG. 2 is a top view of the sanitary-ware of FIG. 1.

Referring now to FIGS. 1 and 2, there is shown a sanitary-ware toilet generally denoted (10) constructed and operative according to some embodiments of the invention. As shown in FIGS. 1 and 2, the sanitary-ware toilet (10) includes a housing (12) covered by a cover (18). Optionally, a hot-water switch (11) may be provided to cause a water heater (not shown) to heat the water before it reaches the bowl, for embodiments where the sanitary-ware is a bidet. In the illustrated embodiment, the housing (12) is integrally formed with a sanitary bowl (16) including a siphon (13), as conventionally known. Thus formed is a horse-shoe shaped cavity, with two extensions (14) forming a kidney-like shape, to be fitted with the flushing assembly. The flushing assembly in these embodiments is a piston flushing assembly, described in detail below, in an optimal space-saving implementation. In this embodiment, sanitary bowl (16) includes a downward depending rim (17*a*) defining a circumferential channel (17*b*) around the interior of the bowl (16). Alternatively, a rimless toilet bowl can be utilized.

Figure 3A:
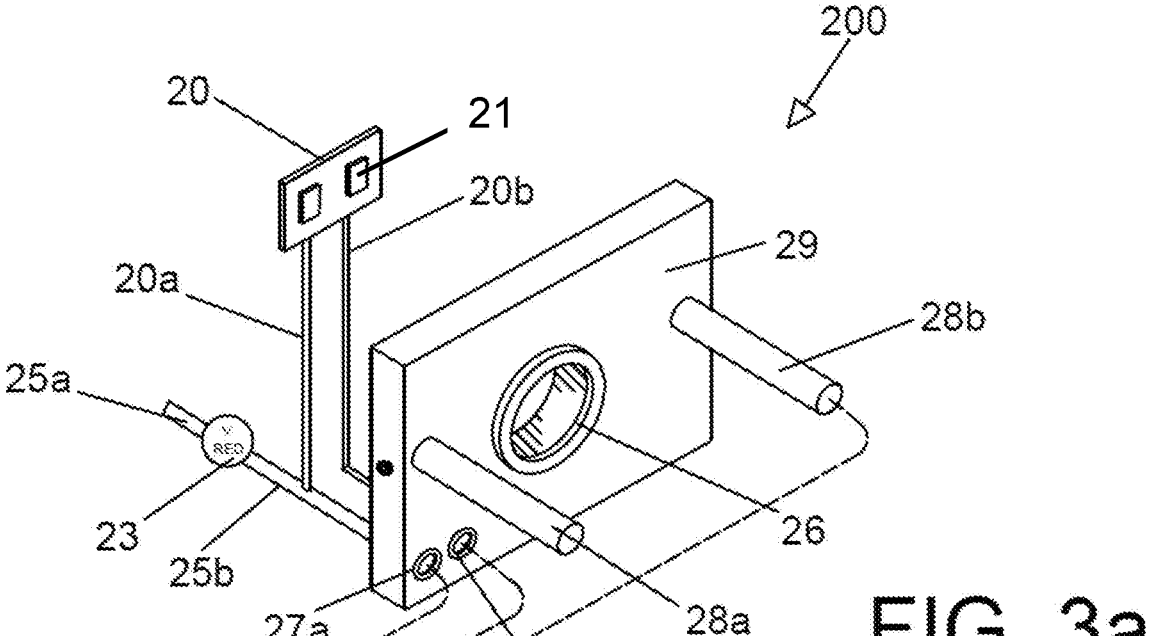
FIG. 3*a* is a schematic three-dimensional view of a mounting plate for the sanitary-ware of FIG. 1.

FIG. 3*a* shows a mounting plate generally denoted (200), of some embodiments of the present invention, including a wall plate (29) having a siphon connector (26) running through the plate for connecting a siphon to a sanitary pipe infrastructure (not shown). Wall plate (29) additionally has quick connectors (27*a*, 27*b*) for water-supply pipes running through the plate and connecting to a source of water under high pressure, such as a mains water supply tube (25*a*).

Preferably, a controller (20), here illustrated as a two positions flushing amount selector, is installed. The controller (20) can be any suitable conventional selector, preferably an hydraulic selector. The controller (20) is connected to the system as by pipes (20*a*) and (20*b*) via a conveying pipe (25*b*). Conveying pipe (25*b*) is connected to the mains water supply by an inlet valve (23) with a pressure reducer. A user interface, such as one or two command buttons (21), is provided to activate the flushing assembly and permit a user to select a desired quantity of flushing water.

The wall plate (29) is adapted to be fastened on its one side to a supporting wall (see FIG. 1) and has prongs (28*a*, 28*b*) protruding from its opposite side. The prongs are designed to support the weight of the whole toilet assembly and user.

The controller (20) includes a pair of hydraulic timers (known per-se) (not shown) and a user interface for regulating the amount of water flushed from the piston flushing assembly to the bowl, such as a command button (21) for the user to activate the desired selection. Pushing the command button for a pre-defined time, say, 5 seconds, will permit a flow of water under pressure into the smaller chamber sufficient for flushing half the quantity of water in the tank, whereas pushing the command button for a prolonged period will result in a longer inflow of water under pressure to permit flushing with the entire quantity of water in the tank. Alternatively, two flushing buttons can be provided, if desired.

Figure 3B:
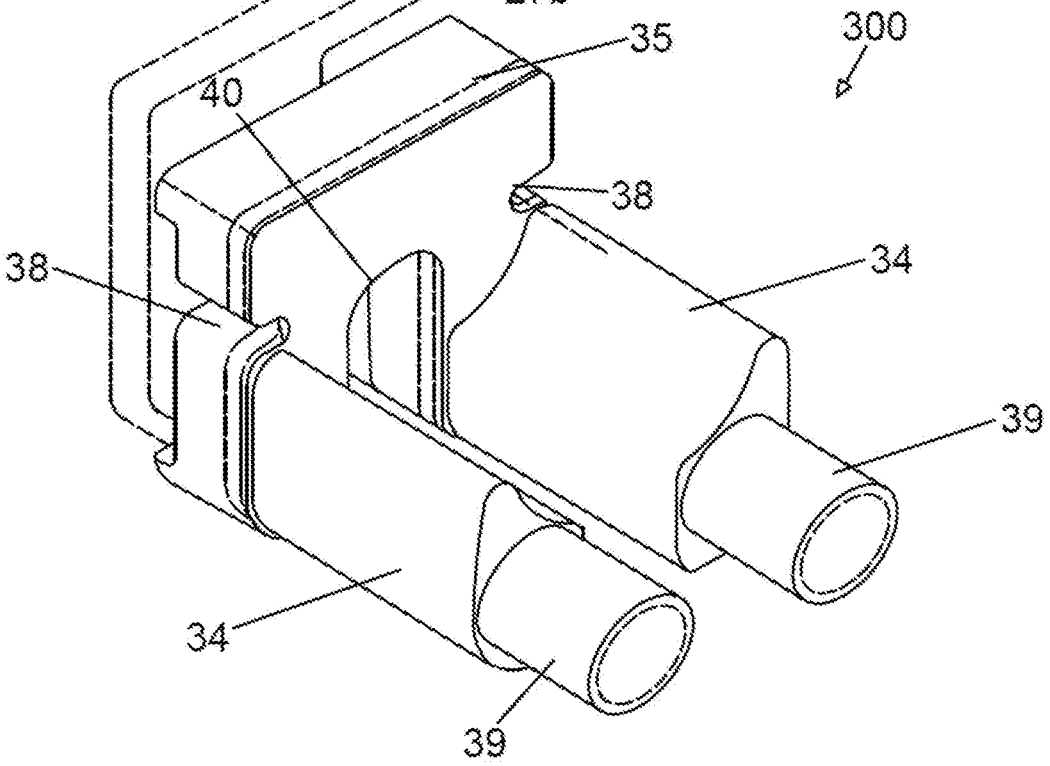
FIG. 3*b* is a schematic three-dimensional view of a piston flushing assembly according to the invention, for the sanitary-ware of FIG. 1.

Reference is now made to FIG. 3*b*. The flushing assembly of this embodiment, generally denoted (300), comprises a generally saddle shaped container or cistern (35) extended by a pair of flushing water tanks, each tank including a first chamber, here shown as a cylindrical housing (39), having a first cross sectional area and a first volume, and a second chamber (34) holding flushing water and having a larger cross sectional area and larger volume than the first chamber, here serving as a piston housing or cylinder. The pair of piston housings (34) form a kidney-like shape. The piston housings (34) will be referred to hereinbelow as second chambers (34). Each such second chamber includes a flushing outlet, described with reference to FIG. 5*a* below. The tanks are designed to fit snugly in the cavity between the housing (12) of the toilet and the bowl (16), and the flushing assembly is, thus, generally saddle shaped. It will be appreciated that this arrangement permits the optimal utilization of the internal volume of housing (12).

Figure 6:
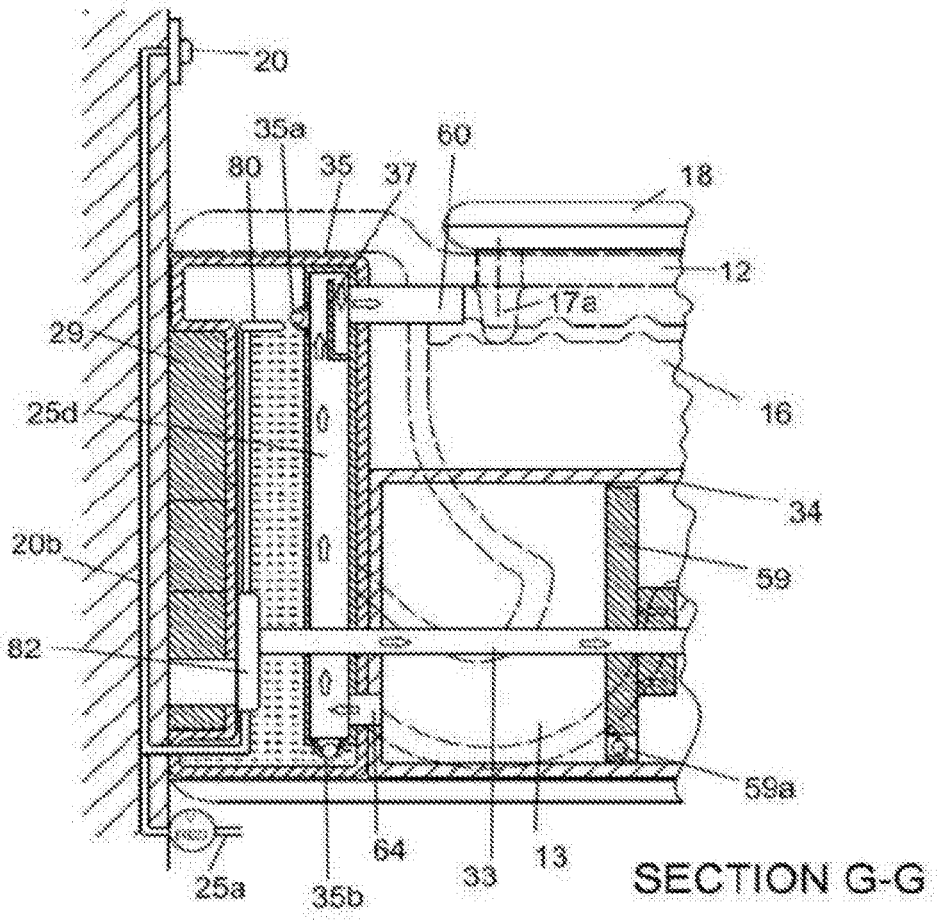
FIG. 6 is a partial view of FIG. 5*a* on an enlarged scale.
Figure 8:
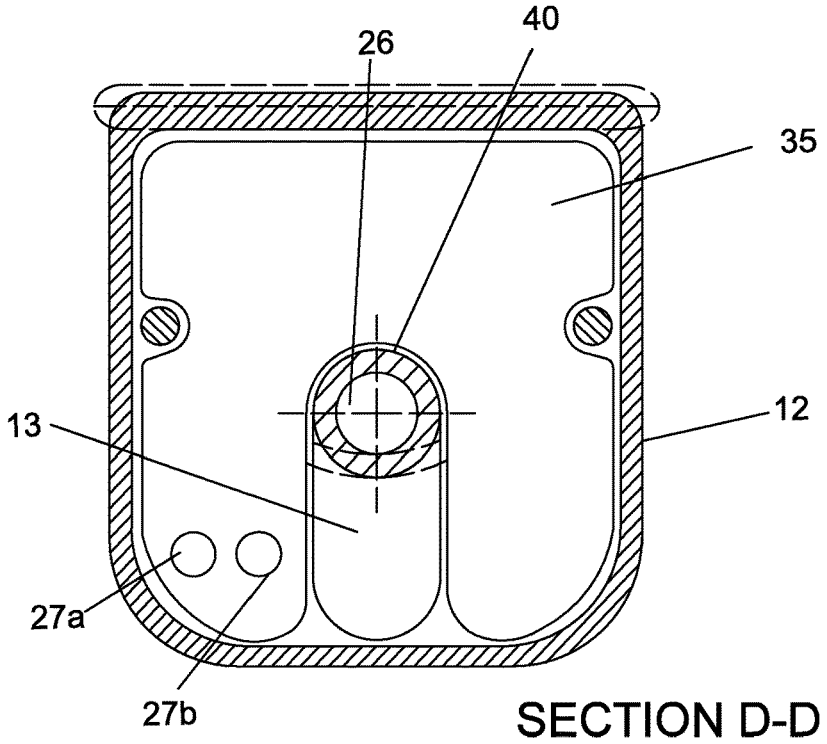
FIG. 8 is a sectional view along D-D of FIG. 4*b;*

Recesses (38) are provided at either side of the housing and are adapted to receive one of the supporting prongs (28*a*, 28*b*) extending outwardly from mounting plate (29). The second chambers (34) of the tanks serve as cylinders for a pair of shaped pistons (59), seen in FIG. 5*a*. Pistons (59) are arranged for reciprocating movement in second chambers (34) by means of a biasing spring. First chambers (39) hold the retracting biasing spring mechanisms (57) of pistons (59), all as described in detail below with reference to FIGS. (5*a*) to (5*c*). Alternatively, the pistons can be retracted by magnets, or by water pressure acting on a second piston inside the small diameter chamber, or by any other suitable mechanism. Cistern (35) is formed with a groove (40) that matches the contour of the siphon when the flushing assembly straddles the siphon (as seen in FIG. 8). Cistern (35)

stores water for filling each second chamber (flushing tank) (34) and includes a one-way valve (35*b*) disposed between the cistern and each second chamber of the tank for selective flow from the cistern to the second chamber (as shown in FIG. 6).

Figure 4A:
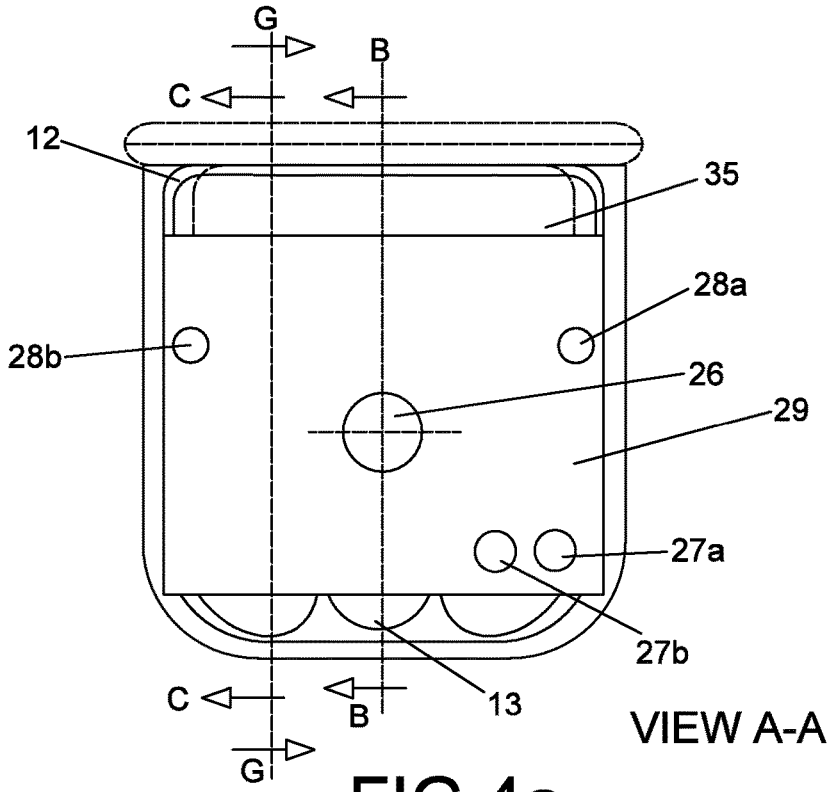
FIG. 4*a* is a view taken along A-A of FIG. 4*b;*
Figure 7:
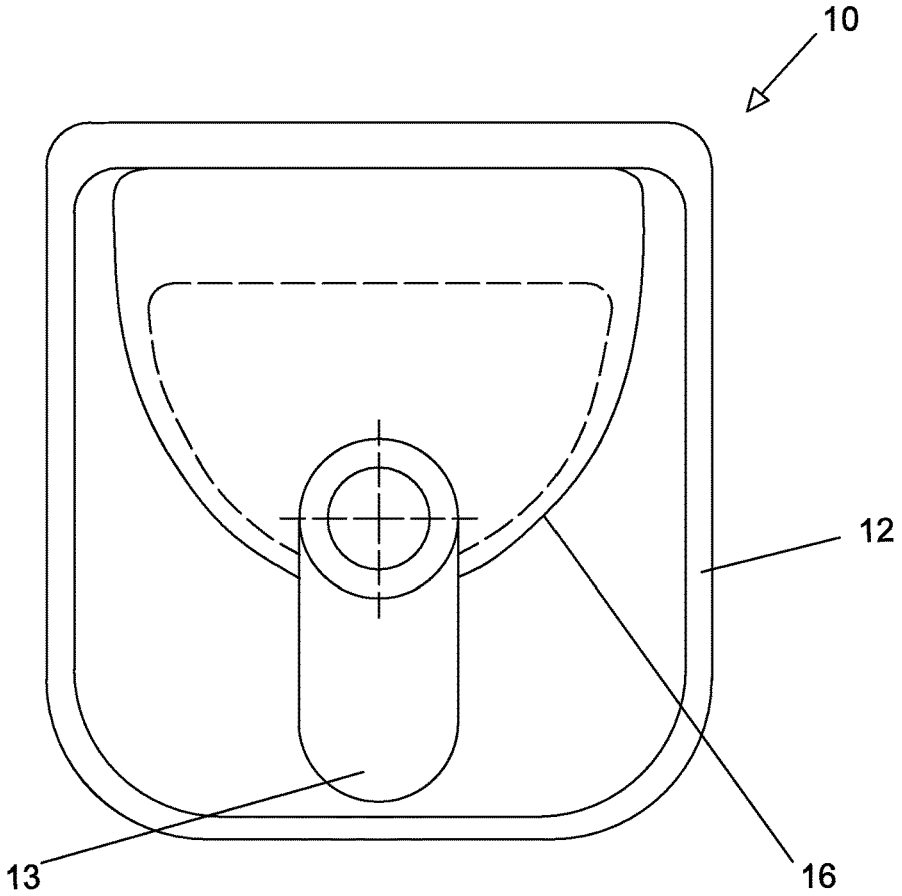
FIG. 7 is a rear view of the sanitary-ware prior to mounting to a mounting plate.

FIG. 4*a* illustrates a rear view of the sanitary-ware toilet of FIG. 1 with the piston flushing assembly of the present invention. FIG. 7 shows a rear view before mounting on a mounting plate. FIG. 4*a* is the view from the rear when mounted on a wall plate. From the rear one can see the wall plate (29) with siphon connector (26) and quick connectors (27*a*, 27*b*) to the water-supply. The top of cistern (35), the sides of housing (12) and the bottoms of second portions (34) and of siphon (13) are visible around the plate. Plate mounting elements may be provided on the rear of the plate for mounting the plate on the wall. In the illustrated embodiment, prongs (28*a*) and (28*b*) also extend through plate (29) and into the wall, thereby also serving as the plate mounting elements although, alternatively or in addition, the plate can be coupled to the wall by screws.

Figure 4B:
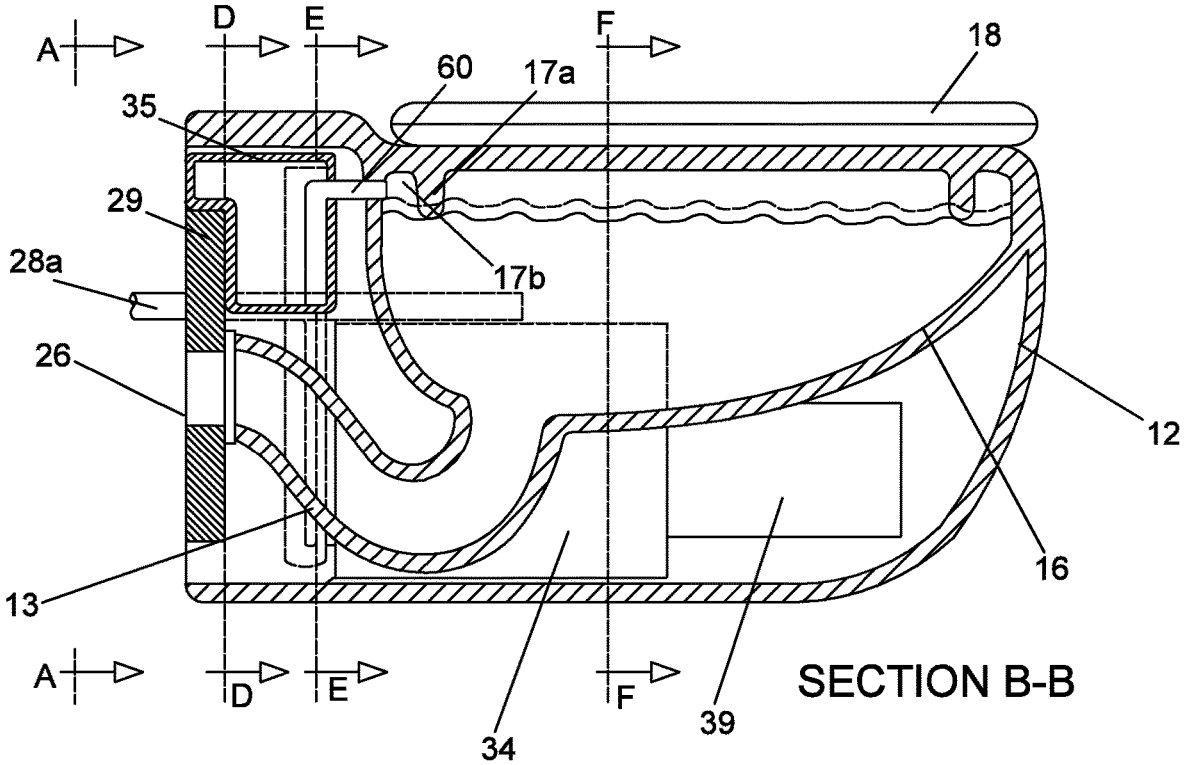
FIG. 4*b* is a sectional view of the sanitary-ware of FIG. 1, taken along B-B of FIG. 4*a;*
Figure 9:
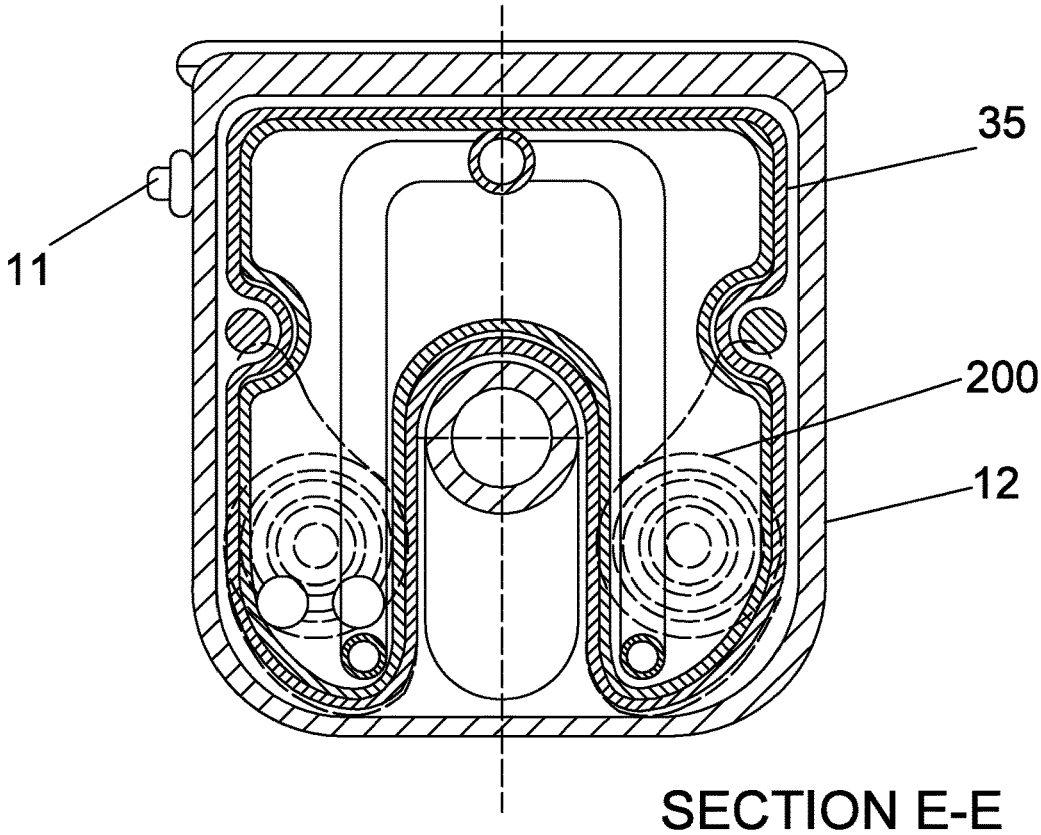
FIG. 9 is a sectional view along E-E of FIG. 4*b;*
Figure 10:
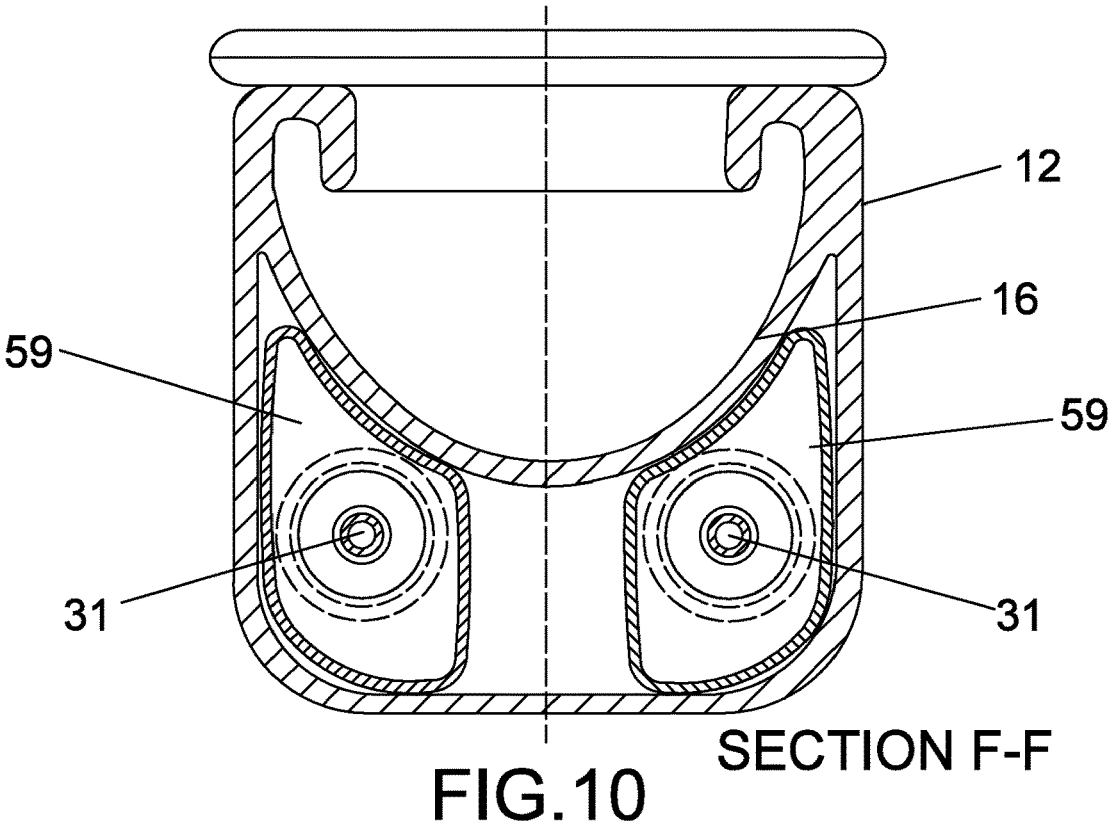
FIG. 10 is a sectional view along F-F of FIG. 4*b;*

FIG. 4*b* is a side sectional view of sanitary-ware toilet (10) as mounted for use. FIG. 9 is a sectional view along E-E of FIG. 4*b* and FIG. 10 is a sectional view along F-F of FIG. 4*b*. As can be seen, housing (12) is mounted on wall plate (29) on prongs (28*a*) and (28*b*) (not seen). In this embodiment, cistern (35) defines a rear recess substantially sized and shaped to receive plate (29). In this way, housing 12 is supported along the entire length of plate (29), as well as on the prongs (28*a*) and (28*b*). Housing (12) includes an integrally formed bowl (16) with a siphon (13) extending from the bottom thereof and connecting to siphon connector (26) that passes through the plate (29) and connects the siphon to a sanitary pipe infrastructure (not shown), substantially as known.

Thus, the flushing assembly includes the pistons (59) and the tanks (34), (39). The second chambers (34) each have a flushing outlet. The flushing assembly also includes a water ejection nozzle (60) coupled by a conduit to the flushing outlet for rinsing the bowl (16). In this embodiment, water ejection nozzle (60) extends into circumferential channel (17*b*), which extends around the interior of the bowl forming a rim, described in detail below with reference to FIG. 6.

Operation of the flushing system of the sanitary-ware of these embodiments is as follows. In general, the flushing mechanism is powered by water under pressure from the mains water supply flowing into the first chamber of the tanks. The flushing assembly includes the piston mounted in the second, larger cross section chamber of the tank, acting as a barrier between the first chamber and the second chamber, that is pushed by the water pressure in the first chamber of the tanks, causing the water in the second chamber of the tank, which is under lower pressure than that in the first chamber, that is sufficient to push the water out of the flushing outlet by the piston and into the bowl.

Reference is now made to FIGS. 5*a*, 5*b*, 5*c* and 6 illustrating the flushing assembly construction and operation according to this embodiment in more detail. Each flushing piston (59) is slidable within the second chamber (34) of its tank in a reciprocal movement towards and away from a flushing outlet (64). There is no need for tight sealing against the inner wall of the housing. A one way valve (59*a*) is provided in piston (59) to allow the retraction of the piston following the flushing stage. The pistons in this embodiment are supported by a hollow sleeves assembly (31), as clearly shown in FIGS. 5*b* and 5*c*. The hollow sleeves assembly (31) is illustrated in this embodiment as being telescopic, for space-saving purposes. Pistons (59) are spring-biased by a tension coil spring (57) disposed in first chambers (39) of the tanks. It will be appreciated that, alternatively, the spring can be coupled to and support the piston, without a hollow sleeves assembly (31). In this embodiment, tension coil spring (57) envelopes a tube (33) that leads from a float control valve (82) through the piston (59) and all the way to a chamber (58) within and at the back side of the sleeves assembly (31), where it is fixed to a plug (56).

When the second chamber (34) of the tank is full, prior to flushing (FIG. 5*a*), the controller (20) is actuated by a user so that full flush or half flush is implemented, as the case may be. When the user presses the control button on the controller (20), the selector permits water from the mains at a first pressure to flow in through conveying pipe (25*b*) and float valve (82), through pipe (33) and out through an opening (52) in tube (33) to fill an internal chamber (58) in one or both first chambers (39). The water pressure or force in internal chamber (58) of first chambers (39) urges pistons (59) towards flushing outlet (64) (FIG. 5*b*), pushing out the larger volume of water from the second chambers (34) and completing flushing within seconds. The flushing water flows from second chambers (34) up through a conduit (25*d*) and to the water ejection nozzle (60), for rinsing the bowl and evacuation through siphon (13) to the siphon outlet (26) (seen in FIG. 4*a*).

It will be appreciated that the inlet water pressure inside first chambers (39) is exchanged to lower pressure of the water in the second chamber (34). However, this lower pressure is still higher than the water pressure in conventional toilet flushing systems that depend on gravity for the flushing power.

Once a flushing cycle is completed (FIG. 5*c*), the pistons (59) are urged to resume their initial, stand-by position (FIG. 5*a*) due to the retraction force of the tension coil springs (57). The vacuum created in the second chamber by the retraction of piston (59) causes valve (35*b*) to open, thereby permitting water to flow from cistern (35) into tank (34) and fill up the second chamber for the next flush. One way valve (59*a*) also opens, permitting water from first chamber (39) to flow into second chamber (34) when the piston is retracted, to empty the first chamber and permit the piston to retract to its original position. When piston (59) is fully retracted to the stand-by position, valves (35*b*) and (59*a*) will close. Water entrapped within the chamber (58) leaks back to the cistern (35), while the selector permits mains water from the line (25*b*) to be supplied through inlet (35*a*) into the cistern, until the cistern is full. A float (80) governs the filling of the cistern. When it reaches a pre-set level, float (80) causes the float valve (82) to close to stop the inflow of water into the cistern. One or more one-way valves (35*a*) control the water flow in the operating path, as well as safeguarding the system against overflow in case of malfunction of the float valve. As best seen in FIG. 6, in such cases, water pressurized within the cistern (35) will force-open the valves (35*a*) and the water will be released to flow (over a baffle (37)) into the bowl and down the drain, until the problem is fixed.

Figure 5A:
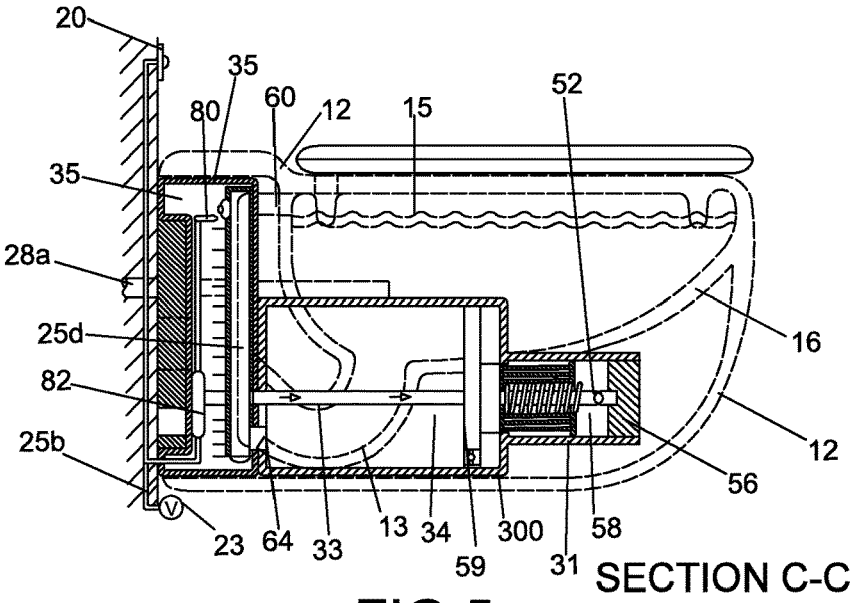
FIG. 5*a* is a sectional view taken along C-C of FIG. 4*a* illustrating the sanitary-ware of FIG. 1 before flushing.
Figure 5B:
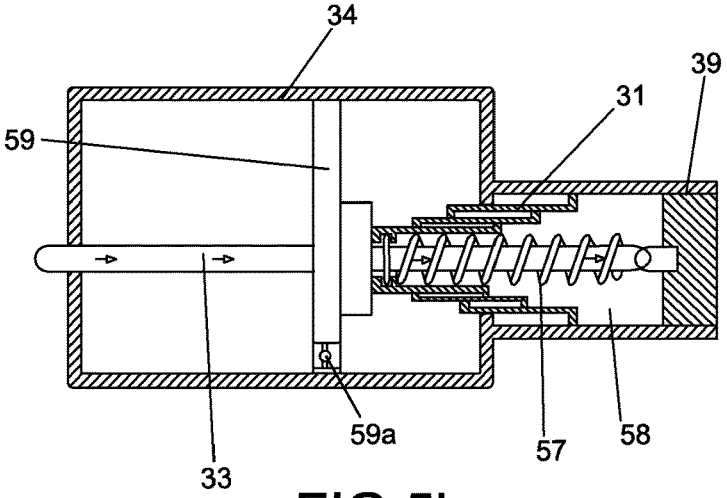
FIG. 5*b* is a detail illustration of FIG. 5*a* in an intermediate stage of flushing.
Figure 5C:
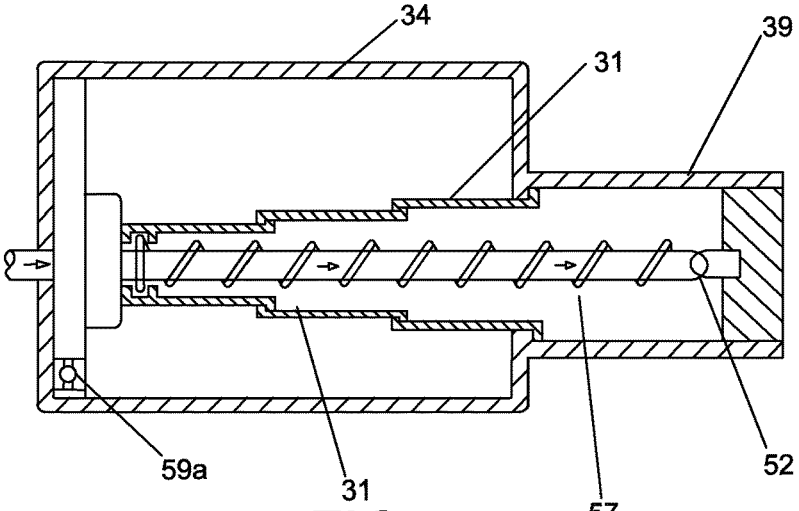
FIG. 5*c* is a detail illustration of FIG. 5*a* in a final stage of flushing.
Figure 5D:
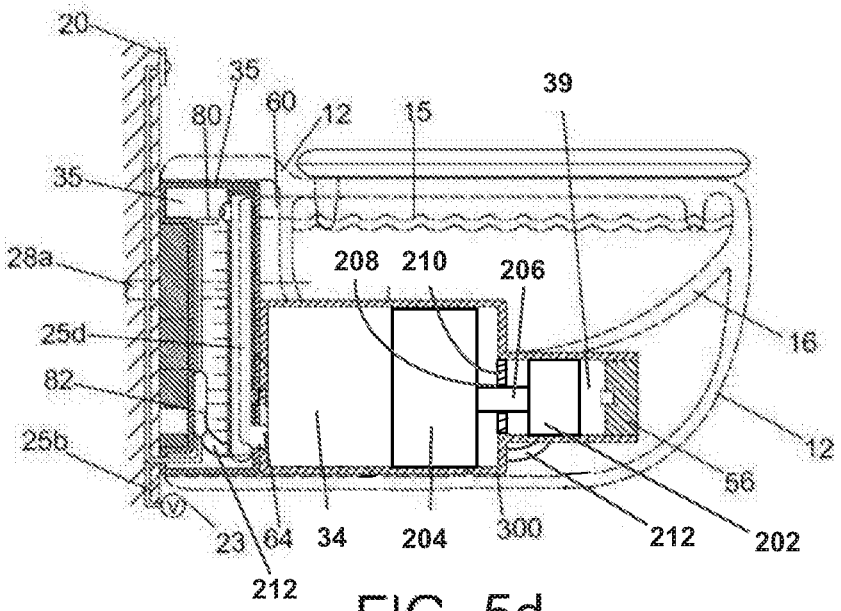
FIG. 5*d* is a side sectional schematic illustration of part of a flushing assembly according to another embodiment of the invention.

Reference is now made to FIG. 5*d*, which is similar to FIG. 5*a*, but shows an embodiment in which the pressure exchanger in each tank is comprised of two rotors mounted on a common axle rather than of a piston as in FIGS. 5*a*, 5*b*, 5*c* and 6. As in the piston embodiment, each tank in this embodiment includes a first chamber (39) having a first volume, and a second chamber (34) having a larger volume than the first chamber. :However, instead of the flushing piston, a first rotor (202) is mounted in first chamber (39) and a second larger rotor (204) is mounted in second chamber (34). The two rotors are mounted on a common axle 206 which passes through an opening (208) in a common wall (210) between the two chambers. As is conventional, the rotors include reaction surfaces, e.g., blades or vanes (not shown) to allow rotor (202) to be driven by water entering the first chamber and allowing rotor (204) to drive the water in the second chamber Water at high pressure is provided to the first chamber (39) in any suitable manner, for example, by a pipe (212) connected to a float control valve (82). Flushing water is provided to second chamber (34) from cistern (35) by a valve and a conduit (not shown).

Operation is largely the same as in the piston embodiment. When a flushing operation is to be initiated, the controller is operated by the user to select a full or half flush. This permits water from the mains at a high pressure to flow in through float valve (82) and pipe (212) to drive rotor (202). Rotation of rotor (202) drives rotor (204) through axle (206) and forces water in the second chamber (34) toward flushing outlet (64) from which it passes through a conduit (25d) to the water ejection nozzle (60).

Once a flushing cycle is completed, second chamber (34) is refilled from cistern 35 for the next flush. Cistern (35) is refilled as in the piston embodiment.

Figure 11:
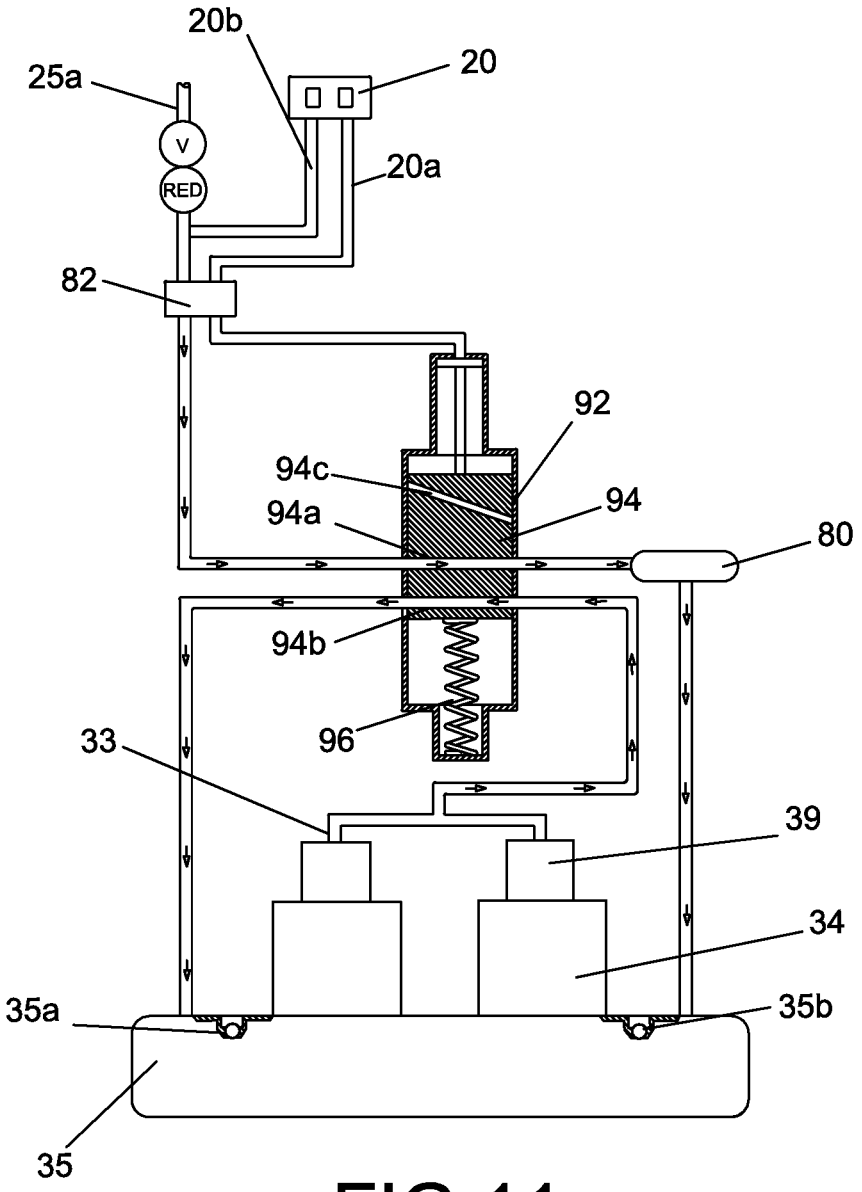
FIG. 11 illustrates a schematic view of a preferred embodiment of the water pressured activated liquid channeling selector device in a first, filling/standby position.
Figure 12:
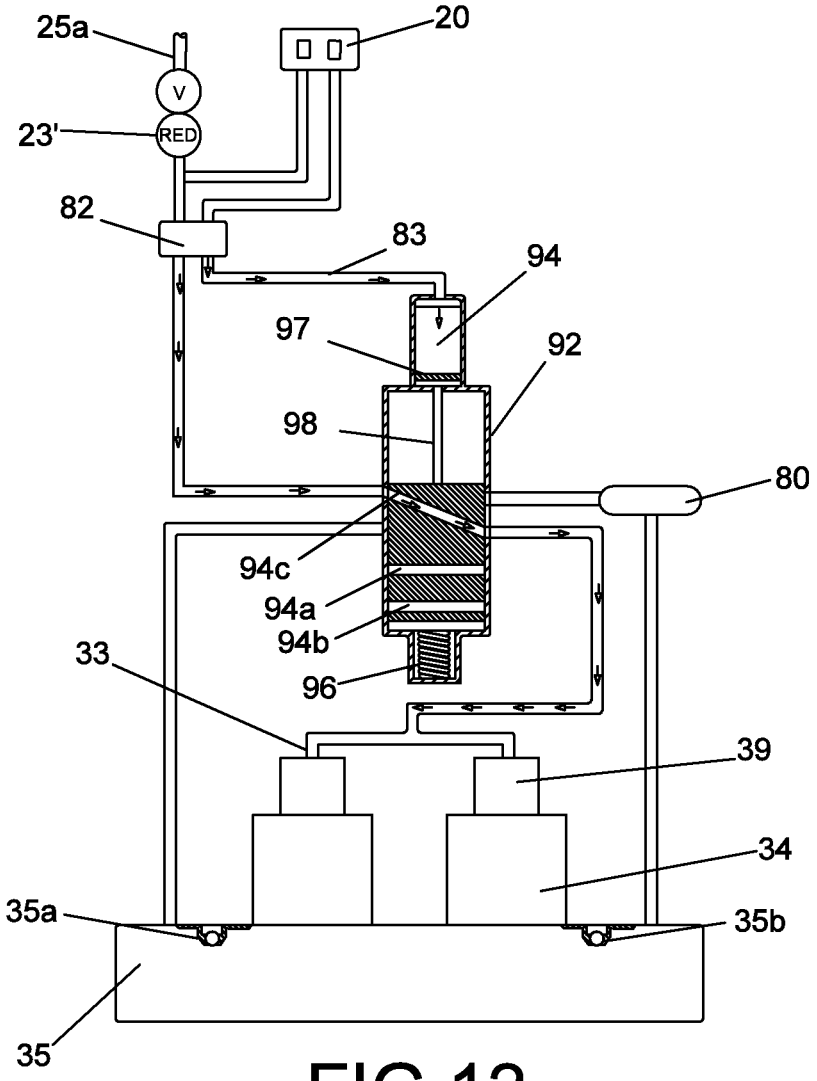
FIG. 12 shows the selector device of FIG. 11 in a second, (half or full) flushing position.

Reference is now made to FIGS. 11 and 12, illustrating a controller or selector control system suitable for use in various embodiments of the present invention. This selector is a liquid pressure operated selector adapted to alternate the circulation of the water from the water source into the flushing assembly or into the cistern. The controller includes a main cylinder housing (92) enclosing a selector piston (94) coupled to a shaft (98) having a plunger (97) adapted to reciprocate between the inactivated position of FIG. 11 and the activated position of FIG. 12. Selector piston (94) includes two diametrical passages (94*a*, 94*b*) and a diagonal passage (94*c*). Suitably positioned openings are provided in the wall of the cylinder housing (92) for allowing the flow of the water via the passages. Hence, in the position of FIG. 11, the "0" or "Stand-by" state of the system, mains water supply can flow from the supply line (25*a*), through the float valve (82), through the diametrical passage (94*a*) via float (80) into the cistern (35). The piston is maintained in this inactivated position by a coil spring (96). In this embodiment of the controller, as well, a user interface is provided for regulating the amount of water flushed from the piston flushing assembly to the bowl.

Once a flushing command is initiated by means of the flushing amount selector in controller (20), a portion of the mains water is diverted through the float valve (82) and a selector pipe (83) and enters the upper chamber (93) of the main cylinder housing (92). In this way, the high mains water pressure is applied to the upper side of plunger (97) acting on piston (94), thereby switching the position thereof to that shown in FIG. 12. Now, water can flow through passage (94*c*), while passages (94*a*, 94*b*) are blocked. Thus, water from the water supply line (25*a*) now enters piston chamber (58) in the first chamber of the flushing tank, initiating the progression of the piston (59) through the second chamber, enabling the flushing stage described above with regard to FIGS. 5*a*, 5*b*, 5*c*.

In a preferred embodiment of the present invention, the water pressure regulator (23') (or the pressure regulator in valve (23)) at the inlet to the system reduces the pressure of the mains water, typically 5-10 atm. to a preferred, fixed pressure (e.g., 1 or 2 atm.) suitable for stably operating the flushing system according to the invention. Alternatively, any other source of water under suitable fixed pressure can be utilized.

It is a particular feature of the present invention that a relatively small quantity of water under a controlled, relatively low pressure (say, 1 or 2 atm.) (relative to the mains pressure) is effective to flush a substantially large amount of water. The water pressure acting on the small quantity of water becomes lower pressure acting on a larger body of water, as it pushes the piston or rotates a rotor to flush out the water.

Numerous changes, variations and modifications may be applied to the invention as so far exemplified. Hence, there can be provided heating means (symbolized by (11) in FIGS. 1 and 9), to heat the water from the second chamber of the tank to a preselected temperature, if the system is intended to function as a 'BIDET'. In this case, a suitable water outlet will be provided instead of the outlet (60), which is directed to the walls of the bowl. Alternatively, or in addition, the system may include a cold water connection, a hot water connection, or a combination thereof.

It will be appreciated that not only retrofit sanitary ware can utilize the flushing assembly of the present invention. Rather, sanitary-ware toilets and bidets can be designed for ease of insertion and removal of the flushing apparatus and, in particular, the control or selector mechanism that directs the flow of water in the sanitary-ware. It will be appreciated that since the bowl and the flushing apparatus of the present invention are all contained aesthetically within the housing, the housing can be mounted on a wall in any suitable fashion or can be free-standing on a floor, as opposed to conventional sanitary ware, where the flushing apparatus is disposed above the bowl or inside a wall. The sanitary ware of the present invention merely requires connection to a high pressure water supply, such as the incoming mains water supply, and to the outgoing sanitary pipe infrastructure.

Referring now to FIGS. 13*a*, 13*b*, 14 and 15, there is shown a sanitary-ware toilet (100) according to alternative embodiments of the invention. Toilet (100) includes a housing (112). In this embodiment, the housing (112) is integrally formed with a sanitary toilet bowl (116), which is, preferably, a ceramic toilet bowl, with a truncated siphon (113). Preferably bowl (116) is covered by a cover (not shown). Housing (112) is designed with an open rear end (114) (seen most clearly in FIG. 13*b*) permitting the insertion and removal of the flushing assembly (118) according to the invention, which can be formed mainly of plastic. Preferably, toilet bowl (116) is a rimless bowl, although a bowl with a rim can also be utilized. Optionally, a hot-water switch (not shown) may be provided to cause a water heater (not shown) the heat the water before it reaches the bowl, for embodiments where the sanitary-ware is a bidet.

The flushing assembly of this embodiment, generally denoted (118), includes a water cistern (135) and one or two water tanks (130), each holding a pressure conversion mechanism. Each tank (130) includes a first chamber (139) of smaller cross section and volume for receiving a small volume of water under pressure, preferably from the mains water supply, and a second chamber (134), of larger cross section and volume, for holding and dispensing the flushing water, for flushing a larger quantity of water at a lower pressure. It will be appreciated that the first chamber corresponds to the first chamber (39) of the embodiment of FIG. 5*a* and the second chamber corresponds to the second chamber (34) of the embodiment of FIG. 5*a*, and both operate in a similar fashion. Each second chamber (134) includes a flushing outlet (164). A plunger or piston (159) is arranged for reciprocating movement in the chamber (134) of larger cross section and is spring-biased, as by a tension coil spring (157). A cistern (135) stores water for filling the chamber (134) of larger cross section of the tank.

The flushing assembly also includes a flushing water conduit (160) for moving the water into the bowl to rinse the bowl (116). In this embodiment, flushing water conduit (160) extends to the inner wall of the bowl and cleans it by means of the water flow.

Figure 13A:
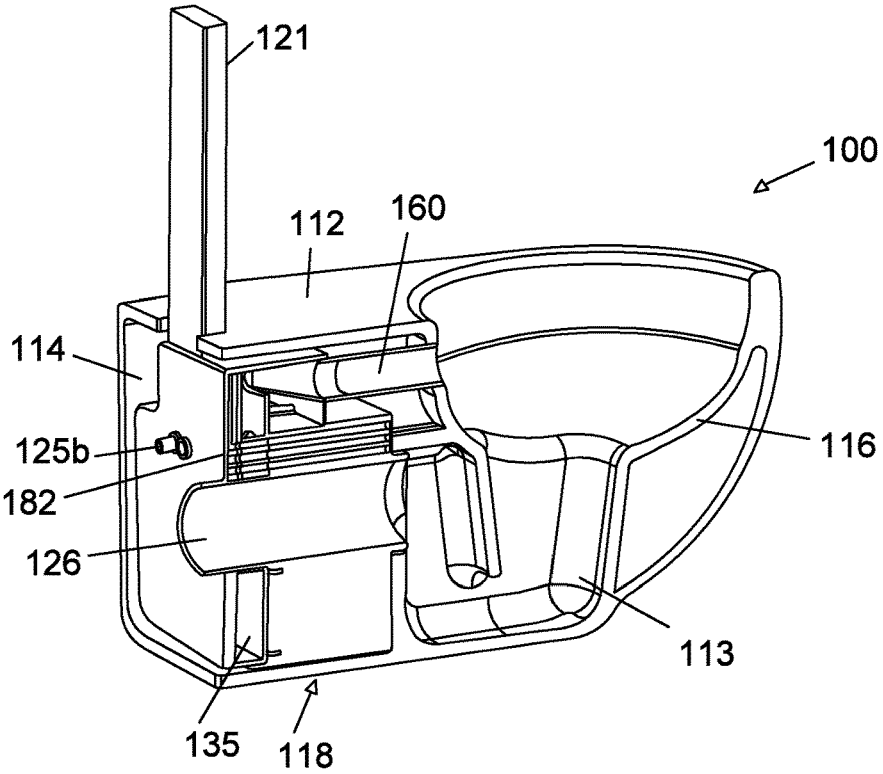
FIG. 13*a* is a schematic isometric side sectional view of an alternative embodiment of sanitary-ware constructed and operative in accordance with the present invention.
Figure 13B:
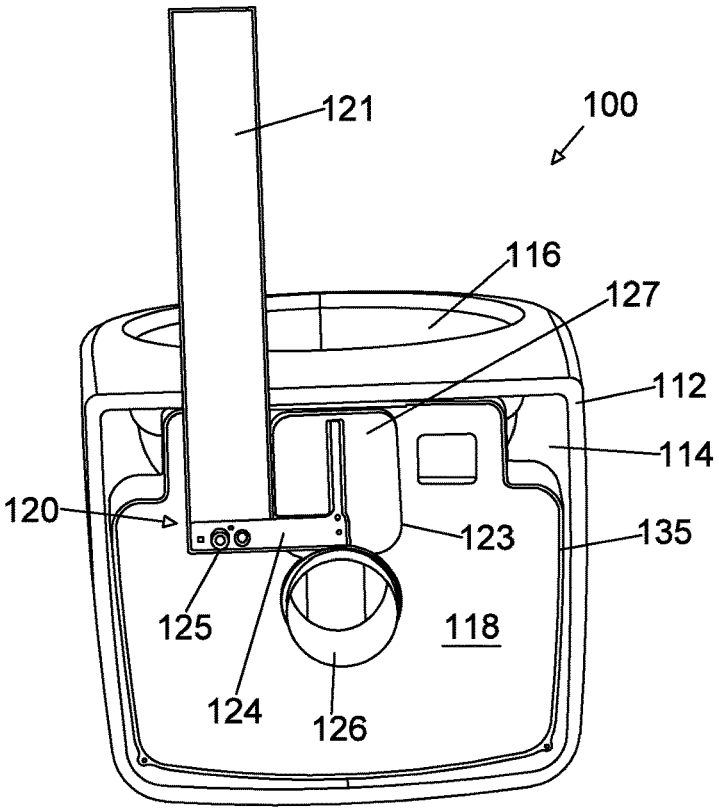
FIG. 13*b* is a schematic rear view of the sanitary-ware of FIG. 13*a;*
Figure 14:
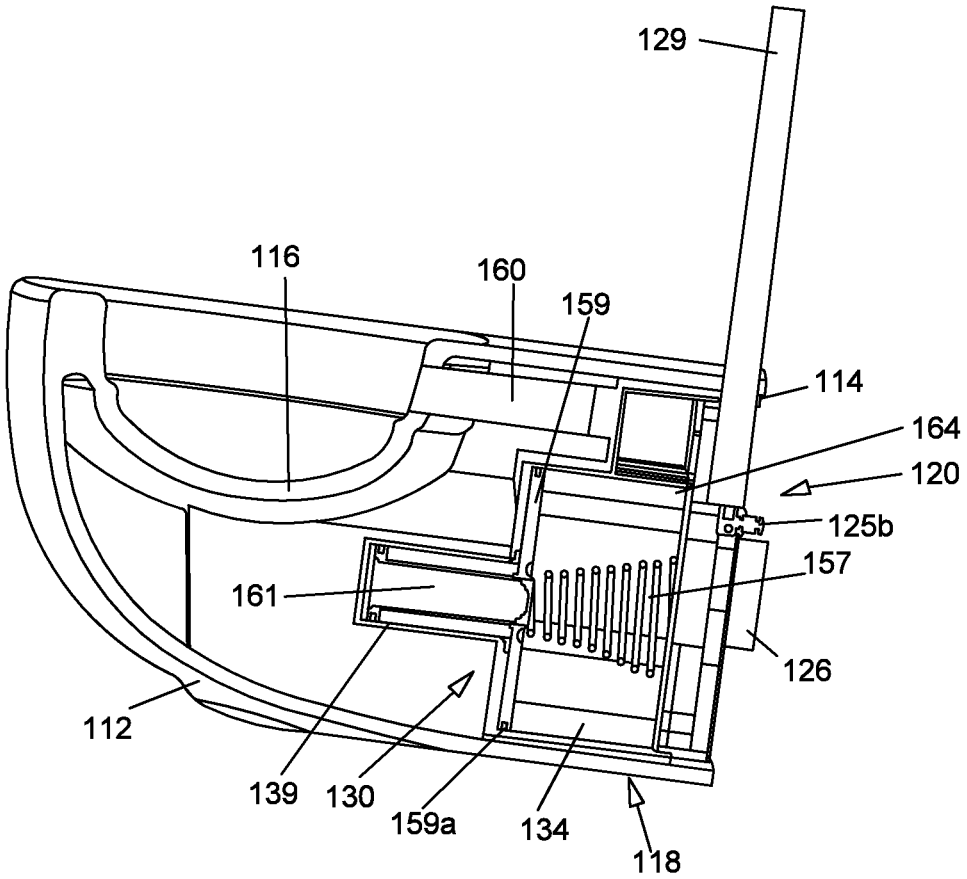
FIG. 14 is a side sectional view of the sanitary-ware of FIG. 13*a* in operation.
Figure 15:
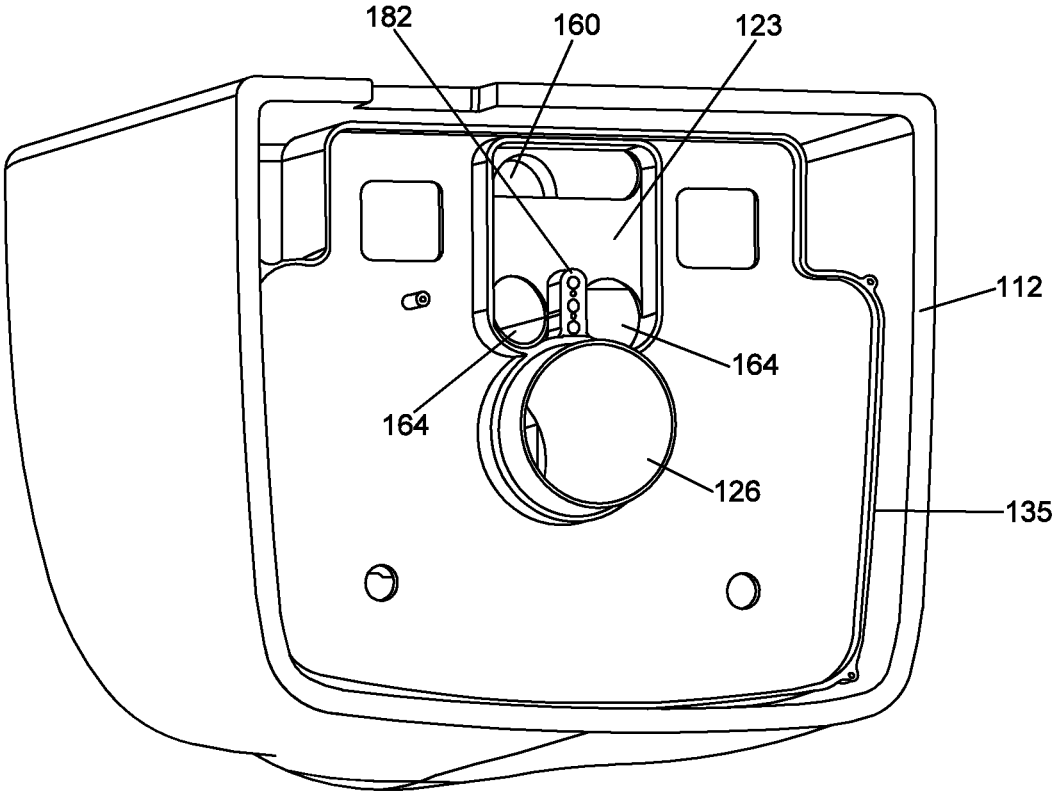
FIG. 15 is a rear view of the sanitary-ware of FIG. 13*a* without a cistern.

The sanitary ware further includes a controller (120), here illustrated as having a two positions flushing amount selector (121) for controlling the direction and quantity of fluid flow through the flushing apparatus. Controller (120) is coupled to a manifold (182) (FIG. 15), which is disposed in a transfer chamber (123), by means of a manifold connector arm (124) (FIG. 13*b*). The transfer chamber (123) is closed by a chamber cover (127). As best seen in FIG. 15, a rear view of the sanitary-ware of FIG. 13*a* without a cistern, the flushing outlets (164) open into transfer chamber (123). Flushing water conduit (160) extends out from transfer chamber (123). Thus, when transfer chamber (123) is closed by the chamber cover (127), flow communication is created between flushing outlets (164) and flushing water conduit (160), allowing the flushing water to enter transfer chamber (123) from the tanks (130) and flow out of transfer chamber (123) through flushing water conduit (160) to flush the bowl.

The controller (120) can be any suitable conventional selector, preferably an hydraulic selector and/or can be the selector (20) described above with regard to FIGS. 11 and 12. A user interface (121), such as one or two command buttons, is provided to permit a user to activate the flushing assembly and select a desired quantity of flushing water. Activating the small quantity selection (e.g., for flushing liquids), as by pushing a command button for a pre-defined time, will permit a flow of water under pressure sufficient for flushing half the quantity of water in the tanks (e.g., the pistons move half the length of the second chamber), while pushing the command button for a prolonged period will result in flushing with the entire quantity of water in the tanks (e.g., for flushing solids). Alternatively, flushing with a small quantity can be accomplished by activating one piston, only, while flushing with the entire quantity of water in the tanks can be accomplished by activating both pistons.

Figure 16A:
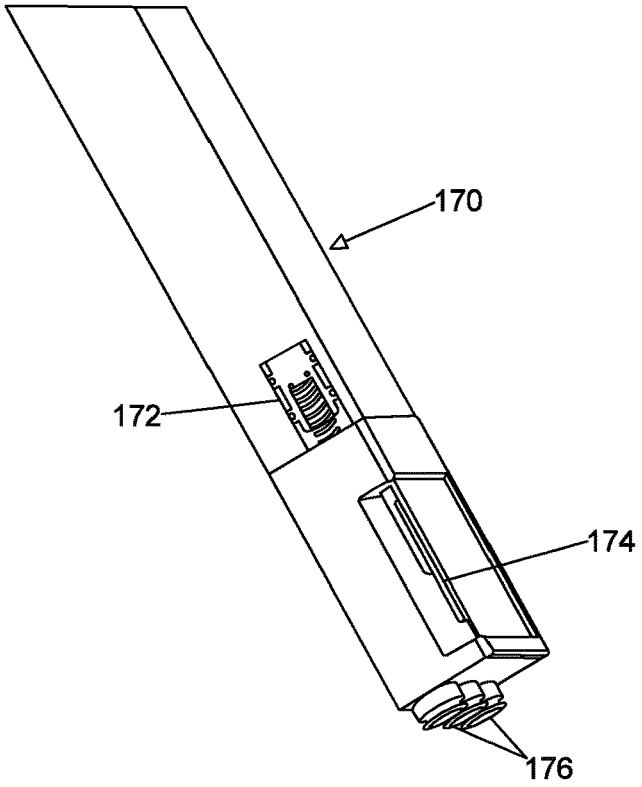
FIG. 16*a* is a schematic partially cut-away view of a controller.
Figure 16B:
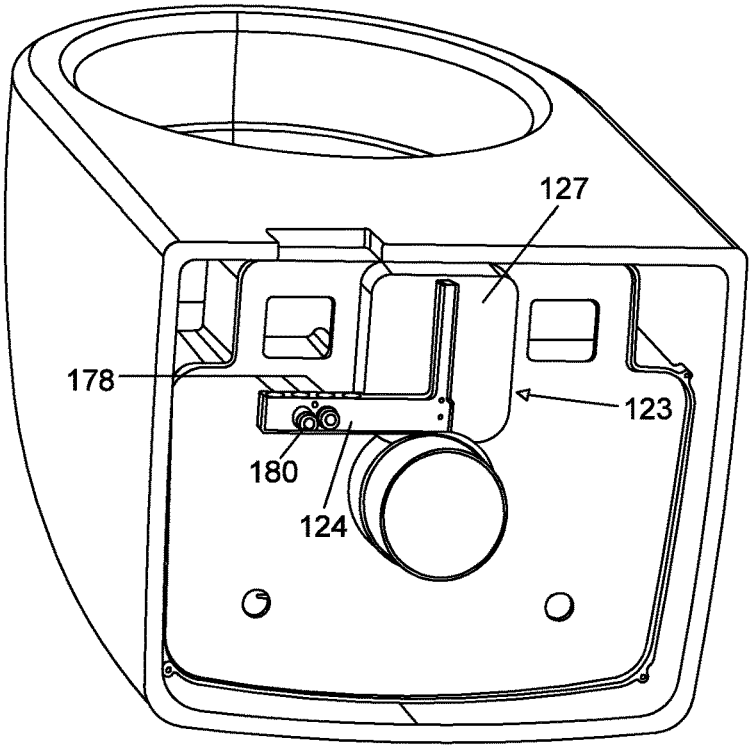
FIG. 16*b* is a rear view illustration a flushing assembly according to the invention.

A controller (170) and a compatible manifold (182), according to embodiments of the invention, are illustrated schematically in FIG. 16*a*, a schematic partially cut-away view of a controller, and FIG. 16*b*, a rear view illustration the flushing assembly, with further reference to FIG. 15. The controller (170) includes a quantity selector (172), a diaphragm (174) for sensing water height in the cistern, and a plurality of quick connectors (176) for connecting via a manifold connector arm (124) to manifold (182). Quick connectors (176) on controller (170) are coupled to complementary connectors (178) on manifold connector arm (124). Manifold connector arm (124) is coupled to the mains water supply by an inlet connector (180) and to manifold (182) in the interior of transfer chamber (123) for flow communication. The controller and the manifold together serve to control the direction and quantity of water flow throughout the sanitary ware housing and the flushing apparatus, in particular. Water from the mains or other high pressure water supply enters the controller, passes through the selector and the manifold, which directs the water flow in one of a plurality of pre-defined flow paths, such as to one tank, to both tanks or to a cistern. Quantity selector (172) is shown as a spring-biased hydraulic selector, for example, such as illustrated in FIGS. 11 and 12. Water from the mains enters controller (170) through inlet connector (180) and one of connectors (178). Depending on the state of the quantity selector (172), the water is directed out through one or two of quick connectors (176) through manifold connector arm (124) and manifold (182) and into one or both of the tanks. During the stable state, controller (170) directs water through the manifold (182) and into the cistern, past the diaphragm (174) until the cistern is full, which causes the diaphragm (174) to cause a lever (not shown) to prevent more water from entering the cistern. One of the connectors (176) provides air to the controller to release the diaphragm, when required.

Figure 17:
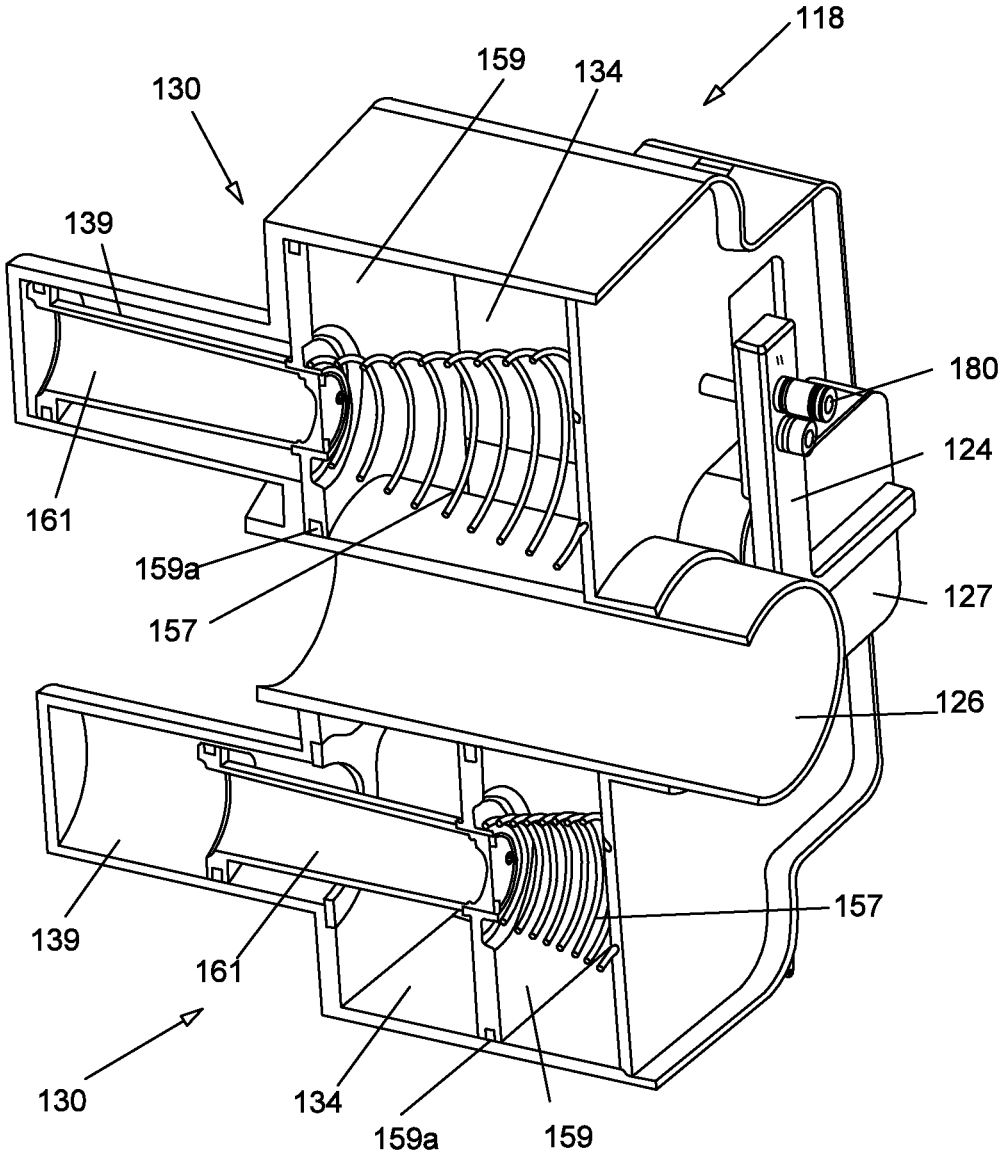
FIG. 17 is a isometric cross-sectional view of the piston flushing assembly looking from the bottom.

Operation of the flushing system of this embodiment of the sanitary-ware is as follows, with additional reference to FIG. 17, an isometric cross-sectional view of the piston flushing assembly according to this embodiment, looking from the bottom. Each piston (159) is slidable within the second chamber (134) of its tank in a reciprocal movement towards and away from a flushing outlet (164). There is no need for tight sealing against the inner wall of the housing. A one way valve (159*a*) is provided in piston (159) to allow the passage of water around the piston to activate the flushing process and to permit the retraction of the piston following the flushing stage. The piston is supported by a piston rod (161), which is hollow in this embodiment, as best seen in FIG. 17.

When the larger cross section chamber (134) of the tank is full, prior to flushing (the top piston in FIG. 17), the controller (120) is actuated by a user so that full flush or half flush is implemented, as the case may be. When the user presses the control button on the controller (120), the selector permits water at high pressure from the mains (180) to flow into and through transfer chamber (123) via manifold (182) and into piston rod (161) to fill the small cross section chamber so as to push against the piston (159) in one or both tanks (130). Thus, water from the high pressure water supply enters the controller, and water from the controller passes through the selector and the manifold to direct the water flow in one of a plurality of pre-defined flow paths, which can include to one tank, to both tanks or to a cistern. The piston (159) is driven, against the action of spring (157), towards the flushing outlet (164) by the pressure of the water introduced into chamber (139) of smaller cross section. The flushing water flows from the larger cross section chamber (134), out through flushing outlet (164) into transfer chamber (123) and into the flushing water conduit (160), for rinsing the bowl and evacuation through siphon (113) to the siphon outlet (126).

It will be appreciated that the high water pressure inside chamber (139) of smaller volume is exchanged for lower pressure acting on the piston (159) which, in turn, acts on the larger volume of water in chamber (134) at lower pressure. However, this lower pressure is still sufficiently high to provide rapid and thorough flushing of the toilet bowl, using less water than is required in conventional flushing systems.

Once a flushing cycle is completed (the bottom piston in FIG. 17), the pistons (159) are urged to resume the initial, stand-by position due to the expansion force of the tension coil spring (157). The vacuum created by the retraction of piston (159) causes a valve (135*b*) to open, thereby permitting water to flow from cistern (135) into the second chamber (134). When piston (159) is fully retracted to the stand-by position, valve (135*b*) will close. Water entrapped within the piston housing (130) leaks back to the larger chamber (134), while mains water from the inlet (180) is supplied through the controller into the cistern, until the diaphragm indicates that the cistern is full. The diaphragm (174) governs the filling of the cistern. When the water reaches a pre-set level, the diaphragm causes the inflow of water into the cistern to stop.

Figure 18:
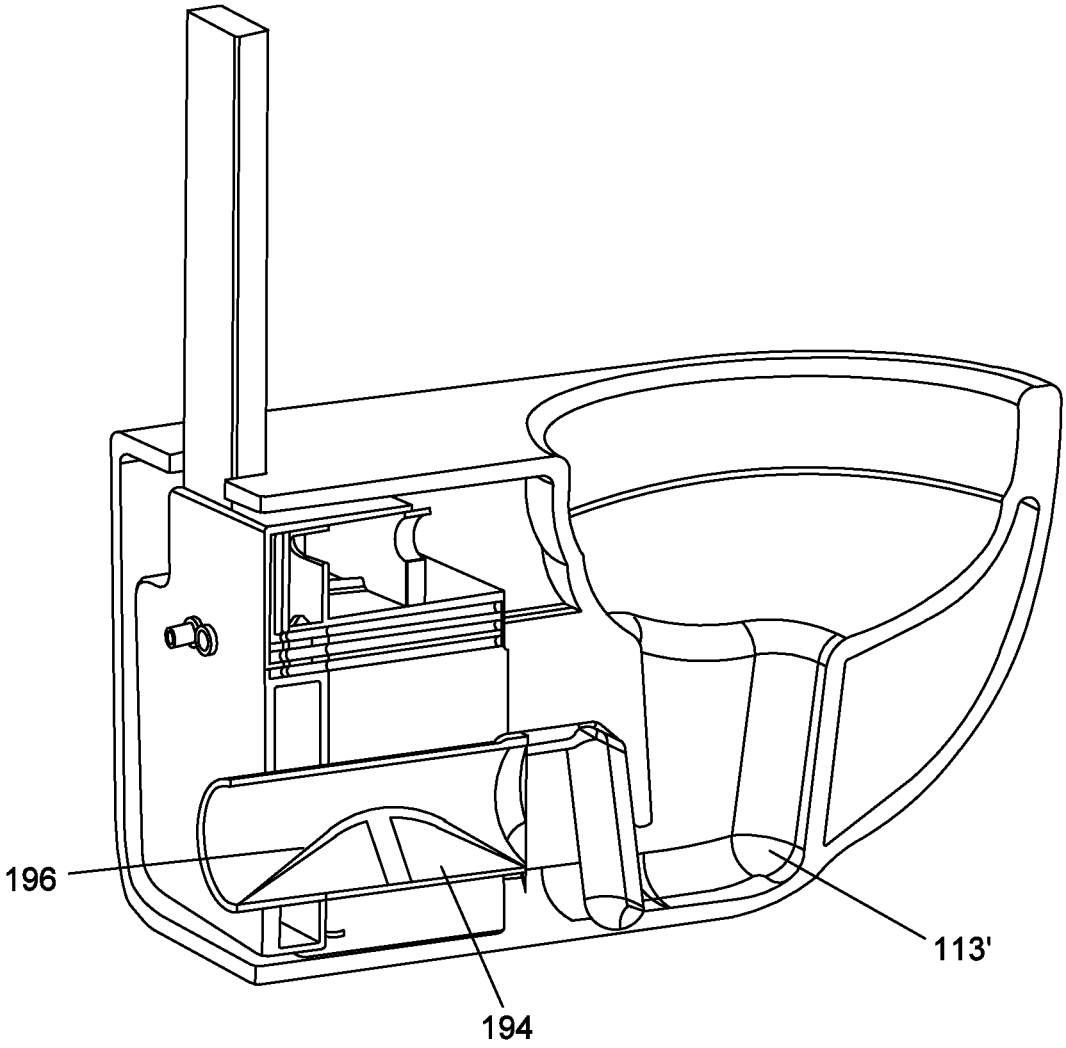
FIG. 18 is a schematic side sectional view of sanitary-ware with a siphon according to embodiments of the present invention.

It will be appreciated that, since the outlet pipe (194) from the siphon (113') is formed as part of the removable flushing apparatus, the height of the bottom wall of the outlet pipe can be selected so as to permit rapid and efficient outflow of the flushing water while still preventing the ingress of unpleasant smells into the siphon. See, for example, FIG. 18, a schematic side sectional view of sanitary-ware with a siphon according to embodiments of the present invention. This can be accomplished by providing a flexible plate (196) in the outlet pipe from the siphon that would flatten against the bottom wall of the pipe during flushing and rise to a desired height for purposes of maintaining the proper water level in the siphon so as to prevent the ingress of gases and smells into the toilet bowl.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A sanitary-ware comprising:

a flushing assembly including :

at least one flushing tank having a first chamber having a first volume and an inlet, and a second chamber having a flushing outlet and a second volume, larger than the volume of the first chamber;

a pressure exchange mechanism disposed between the first chamber and the second chamber and separates said first and second chambers, wherein the pressure exchange mechanism comprises a piston and a piston rod adapted and configured to push against the piston;

the inlet coupled to a source of water at high pressure and receiving a first quantity of water at an inlet pressure from the source; and a cistern;

the first chamber having the first quantity of water therein received at high pressure from the source and the second chamber having a second quantity of water therein received from said cistern;

wherein the first quantity of water in the first chamber applies pressure, by means of said pressure exchange mechanism, to the second quantity of water in the second chamber, the second quantity of water being larger than the first quantity, pushing it out of the second chamber through the flushing outlet at a pressure lower than the inlet source pressure.

2. The sanitary-ware according to claim 1, wherein the source of water at high pressure is a mains water supply.

3. The sanitary-ware according to claim 1, wherein the piston is disposed in the second chamber.

4. The sanitary-ware according to claim 1, further comprising:

a housing;

a bowl disposed in said housing; and a flushing conduit extending from the flushing outlet to an inlet adjacent a top of the bowl;

wherein the flushing assembly is disposed in the housing .

5. The sanitary-ware according to claim 4, wherein the at least one flushing tank comprises two flushing tanks disposed in the housing.

6. The sanitary-ware according to claim 1 further including a heating element for heating water in the at least one flushing tank before dispensing the water into the bowl.

7. The sanitary-ware according to claim 1, further comprising a controller with a flushing quantity selector, the controller coupled via a manifold connector arm to a manifold coupled to the smaller volume chamber and to the cistern, to control a direction and quantity of water flow throughout the flushing assembly.

8. The sanitary-ware according to claim 7, wherein:

the manifold is disposed in a transfer chamber having a transfer chamber cover;

the flushing outlet opens into the transfer chamber; and a flushing water conduit extends out from the transfer chamber;

whereby, when the transfer chamber is closed by the chamber cover, flow communication is created between the flushing outlet and the flushing water conduit, allowing flushing water to enter the transfer chamber from the at least one tank and to flow out of the transfer chamber through the flushing water conduit to flush the bowl.

9. The sanitary-ware according to claim 7, further including a user interface provided with one or two command buttons operable by a user to activate the controller to determine the quantity of water released into the bowl of the sanitary-ware during a flushing operation.

10. The sanitary-ware according to claim 1, wherein the piston rod comprises a hollow sleeves assembly supporting the piston.

11. The sanitary-ware according to claim 1, wherein the piston is arranged for reciprocating movement in the second chamber when a flushing cycle is completed, by means of a biasing spring disposed in the first chamber of the at least one tank.

12. A method for flushing a sanitary-ware bowl associated with a flushing assembly, the method comprising:

introducing a first volume of water under pressure from a high pressure water supply to a first chamber of at least one flushing tank of the flushing assembly, the first chamber having a first volume;

introducing a second volume of water, larger than the first volume of water, to a second chamber of the at least one flushing tank having a volume larger than the first volume;

the first and second chambers being separated by a pressure exchange mechanism disposed there between and having a piston and a piston rod adapted and configured to push against the piston;

applying pressure to the second volume of water, larger than the first volume of water, from the first volume of water in the first chamber, by means of the pressure exchange mechanism;

dispensing flushing water under lower pressure by pressure exerted by the pressure exchange mechanism on the second volume of water, from the second chamber of the flushing assembly into the bowl to flush the bowl; and re-filling the second chamber of the at least one flushing tank of the flushing assembly with flushing water.

13. The method according to claim 12, wherein the first and second chambers are disposed in the at least one flushing tank, and wherein:

the step of introducing includes introducing the first volume of water from a mains water supply to the first chamber;

the step of applying includes applying pressure by the water in the first chamber, to the piston mounted in the second chamber by means of the pressure exchange mechanism, the second chamber holding flushing water and having a larger cross sectional area and larger volume than the first chamber, the piston acting as a barrier between the first chamber and the second chamber; and the step of dispensing includes dispensing flushing water under lower pressure from the second chamber through a flushing outlet into the bowl to flush the bowl.

14. The method according to claim 13, further comprising:

causing water from the high pressure water supply to enter a controller;

causing water from the controller to pass through a selector and a manifold to direct the water flow in one of a plurality of pre-defined flow paths, selected from, to the at least one flushing tank, to two flushing tanks, or to a cistern.

15. The method according to claim 14, further comprising activating flushing of a selected quantity of water by actuating a user interface on the controller.

16. The method according to claim 12, wherein the step of refilling includes sucking water from a cistern through a one-way valve disposed between the cistern and the second chamber of the at least one tank.

17. The method according to claim 12, further including the step of urging the piston to resume an initial stand-by position when a flushing cycle is completed by means of a biasing spring disposed in the first chamber of the at least one tank.

18. A sanitary-ware comprising:

a flushing assembly including:

at least one flushing tank having a first chamber having a first volume and an inlet, and a second chamber having a flushing outlet and a second volume, larger than the volume of the first chamber;

a pressure exchange mechanism disposed between the first chamber and the second chamber and separates said first and second chambers, wherein the pressure exchange mechanism comprises two rotors, a first rotor rotatingly disposed in the first chamber and a second rotor, of larger diameter, rotatingly disposed in the second chamber, and wherein the first rotor and the second rotor are coupled by an axle and mounted thereon for rotation;

the inlet coupled to a source of water at high pressure and receiving a first quantity of water at an inlet pressure from the source; and a cistern;

the first chamber having the first quantity of water therein received at high pressure from the source and the second chamber having a second quantity of water therein received from said cistern;

wherein the first quantity of water in the first chamber applies pressure, by means of said pressure exchange mechanism, to the second quantity of water in the second chamber, the second quantity of water being larger than the first quantity, pushing it out of the second chamber through the flushing outlet at a pressure lower than the inlet source pressure.

* * * * *